US007756463B2

(12) United States Patent
Takahashi

(10) Patent No.: US 7,756,463 B2
(45) Date of Patent: Jul. 13, 2010

(54) IMAGE RECORDING APPARATUS AND ITS CONTROL METHOD

(75) Inventor: Zenji Takahashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 645 days.

(21) Appl. No.: 11/123,072

(22) Filed: May 6, 2005

(65) Prior Publication Data

US 2005/0254870 A1 Nov. 17, 2005

(30) Foreign Application Priority Data

May 11, 2004 (JP) ..... 2004-141121
Feb. 21, 2005 (JP) ..... 2005-044105

(51) Int. Cl.
*G03G 15/00* (2006.01)

(52) U.S. Cl. ..... 399/388; 399/381

(58) Field of Classification Search ..... 399/361, 399/381, 388, 389, 394, 395, 396
See application file for complete search history.

(56) References Cited

U.S. PATENT DOCUMENTS 5,043,771 A * 8/1991 Shibata et al. ..... 399/396
5,307,134 A 4/1994 Nakajima et al.
5,983,066 A * 11/1999 Abe et al. ..... 399/394
6,014,542 A * 1/2000 Hozumi et al. ..... 399/394
6,920,308 B2 * 7/2005 Demchock et al. ..... 399/396

FOREIGN PATENT DOCUMENTS

JP 02163766 A * 6/1990
JP 05-142879 6/1993
JP 07261485 A * 10/1995
JP 2001027834 A * 1/2001
JP 2001315997 A * 11/2001
JP 2003167485 A * 6/2003

* cited by examiner

*Primary Examiner*—Judy Nguyen
*Assistant Examiner*—'Wyn' Q Ha
(74) *Attorney, Agent, or Firm*—Rabin & Berdo, PC

(57) ABSTRACT

After a skew of a sheet as a recording medium is corrected by correcting a sheet curve, exposure writing on a photosensitive drum is started synchronously with re-driving of resist rollers. When a sheet front edge is detected by a sensor, sheet conveyance is continued while adjusting a sheet conveying speed when an exposure start position reaches a transfer position at a pressure contact point between the drum and a transfer roller, thereby adjusting the time of arrival at the transfer position. A time/distance interval between the preceding and subsequent sheets are shortened, a conveying path is shortened, and the whole apparatus is miniaturized. Print processing efficiency is raised and stable printing without a variation is executed. A transfer start position of the sheet is made to accurately coincide with the exposure start position of the drum, thereby realizing a high print processing speed.

9 Claims, 12 Drawing Sheets

IMAGE RECORDING APPARATUS AND ITS CONTROL METHOD

BACKGROUND OF THE INVENTION

1. Field of the Invention

The invention relates to an image recording apparatus such as printing apparatus, facsimile apparatus, copying apparatus, or the like and its control method.

2. Related Background Art

FIG. 11 is a schematic diagram showing an example of an image recording apparatus. Sheets 41 as recording media are enclosed in a sheet cassette 40. A paper feed roller 42 is rotated, thereby feeding out the sheets 41 one by one. The sheet is conveyed to an image forming mechanical unit by resist rollers 43 arranged on a conveying path. A skew correction to correct a curve or the like of the sheet 41 is made by the resist rollers 43. After that, the sheet 41 is conveyed to a photosensitive drum 46 of the image forming mechanical unit.

A first sensor 44 and a second sensor 45 as sheet detecting means are arranged on a conveying path on an upstream side and a downstream side of the resist rollers 43, respectively, thereby detecting passage of a front edge and a rear edge of the sheet 41. When the second sensor 45 detects a front edge 41*a* of the sheet 41, the image forming mechanical unit including the photosensitive drum 46 is made operative by an instruction signal which is generated from a control apparatus (not shown) for controlling the image forming mechanical unit by using a detection signal of the second sensor 45 as a trigger signal. Image light is emitted from an LED head 48 using, for example, a light-emitting diode and irradiated onto the surface of the photosensitive drum 46 charged by a charging unit 47, thereby performing the exposure writing operation and forming an electrostatic latent image onto the surface of the photosensitive drum 46. Toner is adhered onto the formed electrostatic latent image and the image is developed by a developing unit 49 and visualized as a toner image. The toner image is transferred onto the sheet 41 by a transfer roller 50 at a pressure contact point P where the sheet is come into contact with the photosensitive drum 46. The sheet 41 onto which the toner image has been transferred is sent to a fixing unit 52 and ejected onto a stacker (not shown).

FIG. 12 is a time chart showing the sequence operation in the image recording apparatus shown in FIG. 11. After the front edge of the preceding sheet 41 passed through the first sensor 44, the paper feed roller 42 is rotated, so that the next sheet 41 is fed out from the sheet cassette 40 (t1). When the front edge of the sheet 41 is detected by the first sensor 44, the sheet 41 is further conveyed by a predetermined amount and the skew correction of the sheet 41 is made by the resist rollers 43 (t2). The driving of a paper feed motor is stopped and the resist rollers 43 are rotated, thereby conveying the sheet 41 (t3). When the front edge of the sheet 41 is detected by the second sensor 45, the exposure writing operation is started and the conveyance of the sheet 41 by the resist rollers 43 is stopped (t4). After the conveyance of the sheet 41 has been stopped for a predetermined time, the resist rollers 43 are rotated again, thereby conveying the sheet 41 (t5). When an image has been formed and the rear edge of the sheet 41 is detected by the first sensor 44, the next sheet 41 is fed out from the sheet cassette 40. After the sheet 41 was further conveyed by a predetermined amount by the resist rollers 43, the rollers are stopped and the exposure writing operation is stopped at predetermined timing. As for the preceding sheet 41, the image forming process and the sheet ejecting process are executed after that. A sequence for the subsequent sheet is repeated from timing t1 (t6).

As an example of such an image recording apparatus, there is an apparatus disclosed in JP-A-5-142879 which has already been proposed by the same applicant as the present invention, or the like. In this case, by forming a bending at the front edge of the sheet fed out from the sheet cassette by a nip portion of the resist roller, the sheet curve or the like is corrected, thereby making the skew correction. After that, the sheet is fed to the downstream side at proper timing. When the front edge of the sheet is detected by the sheet detecting sensor (second sensor), the exposure writing operation is started in the image forming mechanical unit. The resist roller is temporarily stopped synchronously with such an image forming process, thereby setting the sheet into the standby mode. The start position of the exposure to the photosensitive drum is decided in accordance with the timing when the front edge of the sheet reaches the transfer position where the toner image is transferred by the transfer roller. The resist rollers are rotated again at that timing, thereby conveying the sheet from the standby position to the transfer position.

The conventional image recording apparatus and the technique of the above Official Gazette shown as a specific example, however, have the following problems. In FIG. 11, the exposure on the photosensitive drum 46 is started when the front edge 41*a* of the sheet 41 which has been skew-corrected by the resist rollers 43 is detected by the second sensor 45. In this instance, in order to adjust a time which is required until a start line of the exposure writing operation, that is, the first line of the sheet 41 reaches the pressure contact point P as a transfer position of the transfer roller 50 and a time which is required until the first line of the sheet 41 reaches the pressure contact point P as a position to be printed, the rotation of the resist rollers 43 is temporarily stopped, thereby stopping the conveyance of the sheet 41. If the exposure is started after the front edge of the sheet 41 was detected by the second sensor 45 as mentioned above, since the exposure start becomes late, the printing process eventually takes time.

SUMMARY OF THE INVENTION

It is an object of the invention to provide an image recording apparatus and its control method, in which a transfer start position of a sheet is made to accurately coincide with an exposure start position of an image holding material and a printing process can be executed at a high speed.

According to the present invention, there is provided an image recording apparatus having an exposing unit which exposes an image holding material to form an electrostatic latent image and a conveying unit which is driven by a driving unit after a skew of a recording medium is corrected and conveys the recording medium toward a transfer position, comprising:

exposure control unit which starts driving of the exposing unit on the basis of the driving of the conveying unit;

medium detecting unit which is arranged between the conveying unit and the transfer position and outputs a detection signal when a front edge of the conveyed recording medium is detected; and conveying speed control unit which sets a conveying speed of the conveying unit for matching the recording medium with an exposing position of the image holding material at the transfer position when the detection signal is received and controls the driving unit.

Further, according to the present invention, there is also provided an image recording apparatus having an image holding material which is charged and rotated and is exposed by an exposing unit and on which an electrostatic latent image is formed, a developing unit which adheres toner onto the electrostatic latent image on the image holding material, a medium feeding unit which feeds out a recording medium, a conveying unit which is driven by a driving unit after a skew of the fed-out recording medium is corrected and which conveys the recording medium toward a transfer position, and a transfer unit which transfers the toner adhered on the image holding material onto the recording medium which is arranged at the transfer position and is conveyed, comprising:

exposure control unit which drives the exposing unit on the basis of the driving of the conveying unit;

medium detecting unit which is arranged between the conveying unit and the transfer position and outputs a detection signal when a front edge of the conveyed recording medium is detected; and conveying speed control unit which measures a time which is required until the detection signal is received after the driving of the conveying unit is started, sets a conveying speed of the conveying unit in order to allow an exposure start position of the image holding material to coincide with a transfer start position of the recording medium at the transfer position on the basis of a time difference between the measured time and a set time, and controls the driving unit.

In the image recording apparatus, the driving unit which drives the conveying unit is a pulse motor, and the apparatus further comprises paper feed control unit which drives the medium feeding unit when pulses of the number corresponding to a length dimension of the recording medium are supplied to the pulse motor after the detection signal was received.

Moreover, in the image recording apparatus, the conveying speed control unit sets the same conveying speed as a peripheral speed of the image holding material and a low speed for adjustment lower than the conveying speed into the conveying unit and sets an adjustment time for driving the conveying unit at the low speed in correspondence to the time difference between the measured time and the set time.

Moreover, in the image recording apparatus, the conveying speed control unit sets the same conveying speed as a peripheral speed of the image holding material into the conveying unit, sets a low speed for adjustment lower than the conveying speed, sets an adjustment time for driving the conveying unit at the low speed in correspondence to the time difference between the measured time and the set time, and discriminates whether or not the low speed can be set on the basis of the time difference. Then, the image recording apparatus further comprises a cleaning sequence control unit which, if the conveying speed control unit determines that the setting of the low speed is impossible, stops the driving unit, controls the exposure control unit so as to stop the driving of the exposing unit, stops supply of a developing voltage to the developing unit for a predetermined time so as to prevent the toner from being adhered onto the electrostatic latent image formed on the image holding material, and stops supply of a transfer voltage for a predetermined time so as to prevent the toner adhered on the image holding material from being transferred to the transfer unit; an exposure re-driving control unit which controls the exposure control unit so as to drive the exposing unit again when the stop of the supply of the developing voltage and the stop of the supply of the transfer voltage are cancelled; and a re-conveyance control unit which sets the conveying speed of the conveying unit in correspondence to the re-driving of the exposing unit and controls the driving unit.

Moreover, in the image recording apparatus, the exposure control unit has a dot counter which counts the number of dot data which is supplied to the exposing unit in order to form the electrostatic latent image. Then, the image recording apparatus further comprises an exposure discrimination activating unit which, if the conveying speed control unit determines that the setting of the low speed is impossible, fetches a count value of the dot counter, if the count value is equal to "0", stops the driving unit without activating the cleaning sequence control unit, controls the exposure control unit so as to stop the driving of the exposing unit, and activates the exposure re-driving control unit and the re-conveyance control unit.

Moreover, in the image recording apparatus, the driving unit which drives the conveying unit is a driving motor, and the conveying speed control unit sets the same conveying speed as a peripheral speed of the image holding material into the conveying unit and increases a current which is supplied to the driving motor for an adjustment time corresponding to the time difference between the measured time and the set time.

Further, according to the present invention, there is provided an image recording control method of forming an electrostatic latent image onto an image holding material by exposing the image holding material by an exposing unit and conveying a skew-corrected recording medium to a transfer position by driving a conveying unit, comprising the steps of:

allowing the exposing unit to start the exposure on the basis of the driving of the conveying unit;

after that, when a front edge of the conveyed recording medium is detected, setting a conveying speed for matching the recording medium with an exposing position of the image holding material at the transfer position; and driving the conveying unit at the conveying speed.

Further, according to the present invention, there is also provided an image recording control method of forming an electrostatic latent image onto an image holding material which is charged and rotated by exposing the image holding material by an exposing unit, adhering toner onto the electrostatic latent image by a developing unit, conveying a fed-out and skew-corrected recording medium to a transfer position by a conveying unit, and transferring the adhered toner onto the recording medium by a transfer unit at the transfer position, comprising the steps of:

allowing the exposing unit to start the exposure on the basis of driving of the conveying unit;

if medium detecting unit arranged between the conveying unit and the transfer position detects a front edge of the recording medium, measuring a time which is required until the front edge is detected after the driving of the conveying unit is started; and setting a conveying speed for allowing an exposure start position of the image holding material to coincide with a transfer start position of the recording medium at the transfer position on the basis of a time difference between the measured time and a set time and driving the conveying unit at the conveying speed.

In the image recording control method, the conveying unit is driven by a pulse motor, and when pulses of the number corresponding to a length dimension of the recording medium are supplied to the pulse motor after the medium detecting unit detects the front edge, a paper feed of the next recording medium is started.

Moreover, in the image recording control method, the same conveying speed as a peripheral speed of the image holding material and a low speed for adjustment lower than the conveying speed are set into the conveying unit; and an adjustment time corresponding to the time difference between the measured time and the set time is discriminated and the conveying unit is driven at the low speed for the adjustment time.

Moreover, in the image recording control method, the same conveying speed as a peripheral speed of the image holding material and a low speed for adjustment lower than the conveying speed are set into the conveying unit; an adjustment time corresponding to the time difference between the measured time and the set time is discriminated and the conveying unit is driven at the low speed for the adjustment time; whether or not the setting of the low speed is possible is discriminated on the basis of the time difference, and if the setting of the low speed is impossible, the conveying unit and the exposing unit are stopped; supply of a developing voltage to the developing unit is stopped for a predetermined time so as to prevent the toner from being adhered onto the electrostatic latent image formed on the image holding material and supply of a transfer voltage is stopped for a predetermined time so as to prevent the toner adhered on the image holding material from being transferred to the transfer unit; and the exposing unit is driven again when the stop of the supply of the developing voltage and the stop of the supply of the transfer voltage are cancelled and the conveying speed of the conveying unit is controlled in correspondence to the re-driving.

Moreover, in the image recording control method, the number of dot data supplied to the exposing unit in order to form the electrostatic latent image is counted; if the setting of the low speed is impossible and a value of the count is equal to "0", the conveying unit and the exposing unit are stopped; and the exposing unit is driven again without stopping the supply of the developing voltage and the supply of the transfer voltage and the conveying speed of the conveying unit is controlled in correspondence to the re-driving.

According to the invention, since the exposure on the image holding material is started and the conveying speed of the recording medium is adjusted synchronously with the conveyance of the skew-corrected recording medium, the transfer start position can be accurately coincident with the exposure start position and the printing time of the recording medium can be shortened.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

Embodiment 1

Construction of Embodiment 1

Figure 1:
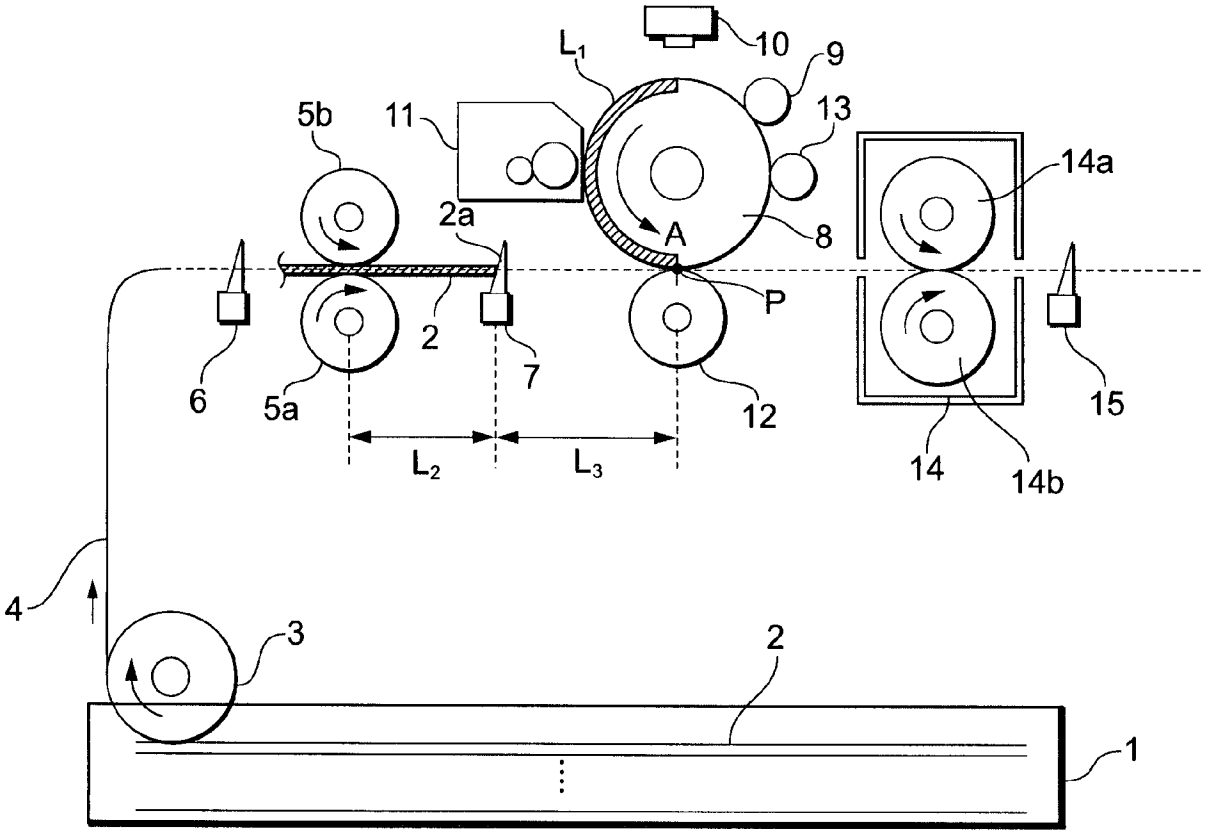
FIG. 1 is a side elevational view showing an image recording apparatus according to the invention.

FIG. 1 is a side elevational view showing a construction of the embodiment 1. Sheets 2 as recording media set in a sheet cassette 1 are fed out one by one to the outside of the cassette by a paper feed roller 3. A pair of resist rollers 5*a* and 5*b* for conveying the sheet 2 fed out from the sheet cassette 1 are arranged as conveying members on a conveying path 4 subsequent to the paper feed roller 3. A first sensor 6 as medium detecting means is arranged on the conveying path 4 of an upstream side just before the resist rollers 5*a* and 5*b*, thereby detecting passage of a front edge and a rear edge of the sheet 2 fed out from the sheet cassette 1. A second sensor 7 as medium detecting means is also arranged on the conveying path 4 of a downstream side of the resist rollers 5*a* and 5*b*, thereby detecting the front edge of the sheet 2 which is conveyed by the resist rollers 5*a* and 5*b* and passes. A photosensitive drum 8 as an image holding material serving as a principal portion of the image forming mechanical unit is arranged further on the downstream of the second sensor 7.

Figure 2:
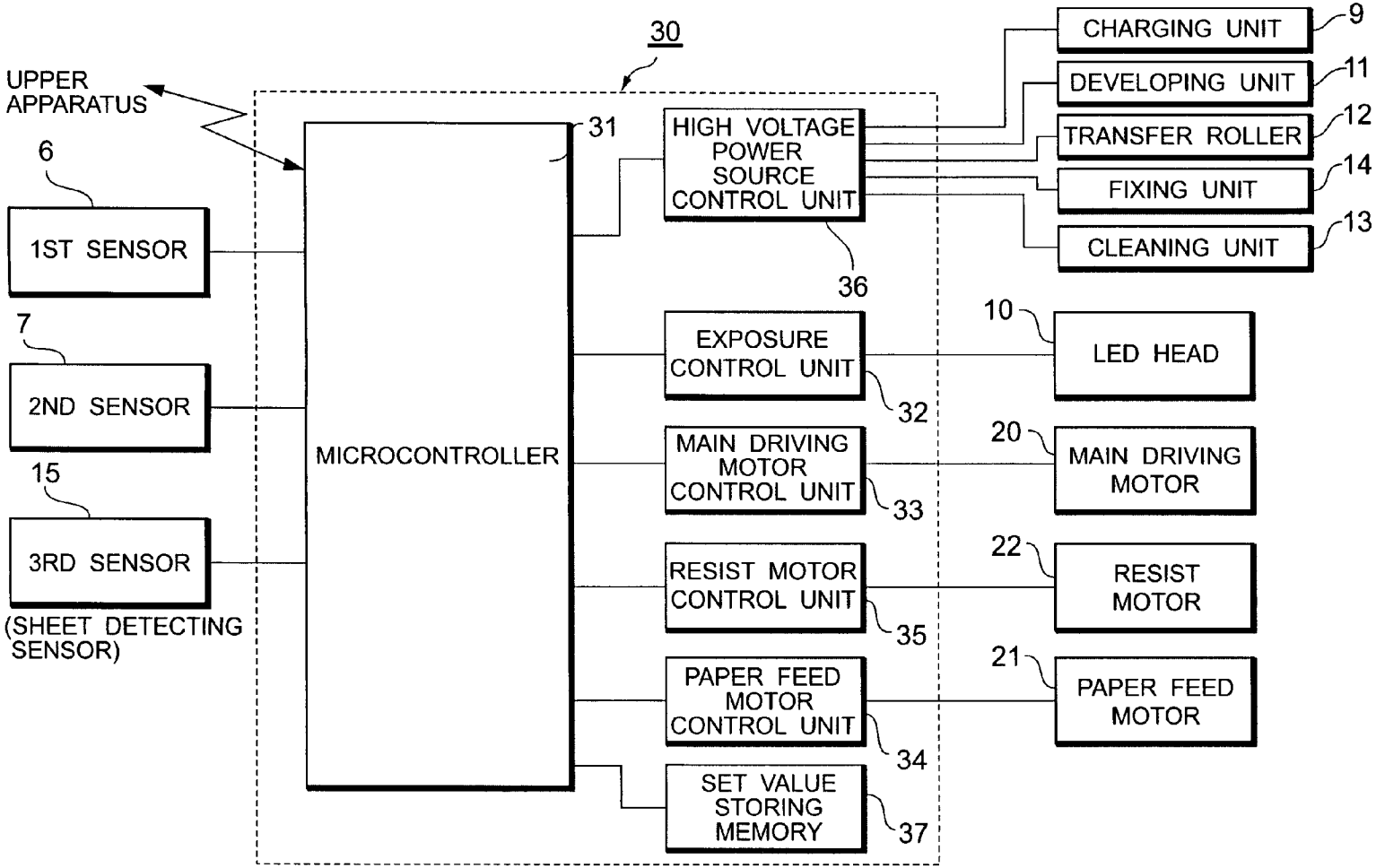
FIG. 2 is a functional block diagram showing a mechanism control unit according to the embodiment 1.

The following devices constructing the image forming mechanical unit are arranged around the photosensitive drum 8: a charging unit 9 for charging the surface of the photosensitive drum 8: an LED head 10 constructed by a light-emitting diode serving as exposing means for forming an electrostatic latent image onto the photosensitive drum 8; a developing unit 11 serving as developing means for adhering toner onto the electrostatic latent image on the photosensitive drum 8, thereby forming a toner image; a transfer roller 12 serving as transfer means for transferring the toner image on the photosensitive drum 8 onto the sheet 2 at the pressure contact point P; and a cleaning unit 13 for removing the toner remaining on the photosensitive drum 8 after the transfer of the toner image. The following devices are provided on the downstream conveying path 4 of the photosensitive drum 8: a fixing unit 14 comprising a pair of upper heat roller 14*a* and a lower pressure contact roller 14*b* for fixing the toner on the sheet 2 after the transfer onto the sheet 2; and a third sensor 15 serving as medium detecting means for detecting that the sheet 2 ejected from the fixing unit 14 has been delivered onto the stacker (not shown). FIG. 2 shows a functional block diagram of a control apparatus 30 for integratedly controlling each of the foregoing unit and devices. As shown in the diagram, the control apparatus 30 is equipped with a main driving motor 20 for applying a predetermined rotating force to each of the photosensitive drum 8, transfer roller 12, and fixing unit 14. The control apparatus 30 is also equipped with: a paper feed motor 21 for applying a predetermined rotating force to the paper feed roller 3; and a resist motor 22 for applying a predetermined rotating force to the resist rollers 5*a* and 5*b*.

As shown in FIG. 2, the control apparatus 30 has a microcontroller 31 serving as a main control unit. The microcontroller 31 has therein: a CPU comprising a control unit and an arithmetic operating unit; a RAM and a ROM as program memories; a timer counter; and the like. The microcontroller 31 activates each of the foregoing unit and devices and switches their control on the basis of detection signals from the first sensor 6, second sensor 7, and third sensor 15 which are inputted from input ports. An exposure control unit 32, a main driving motor control unit 33, a paper feed motor control unit 34, a resist motor control unit 35, and a high voltage power source control unit 36 are connected to the microcontroller 31. The exposure control unit 32 receives image data from an upper apparatus such as a client PC (computer) or the like whose input has been operated by the user, transmits it to the LED head 10 using, for example, the light-emitting diode, and controls in such a manner that the image light is irradiated from the LED head 10 to the photosensitive drum 8 and exposes it to thereby form the electrostatic latent image and the image data of one page is repeatedly written every line at a predetermined period. The main driving motor control unit 33 sends an operation signal to the main driving motor 20 and controls a rotational speed. The paper feed motor control unit 34 sends an operation signal to the paper feed motor 21 and controls its rotation. The resist motor control unit 35 sends an operation signal to the resist motor 22 and controls its rotation. A two-phase exciting pulse motor or the like is used as each of those motors. By supplying a constant current to each motor and switching the phase current direction at a leading edge of a clock signal or changing a clock frequency, acceleration or deceleration of the motor rotation is controlled. The microcontroller 31 further has the high voltage power source control unit 36, thereby controlling a voltage which is applied to each of the charging unit 9, developing unit 11, transfer roller 12, and fixing unit 14.

Operation of Embodiment 1

The operation and functions of the embodiment 1 of the image recording apparatus will now be described.

The user operates the input of the upper apparatus, forms image data such as document, figure, or the like, outputs a signal to instruct printing of the image data and the image data from the upper apparatus, and transmits them to the control apparatus 30 of the image recording apparatus. When the microcontroller 31 of the control apparatus 30 receives the signal to instruct the printing, the microcontroller 31 transmits an instruction signal to drive the main driving motor 20 to the main driving motor control unit 33, thereby rotating the motor 20 at a predetermined rotational speed (rpm). The rotation of the main driving motor 20 is propagated to each of the photosensitive drum 8, transfer roller 12, and fixing unit 14. The high voltage power source control unit 36 applies a predetermined voltage to each of the charging unit 9, developing unit 11, transfer roller 12, and fixing unit 14 at predetermined timing.

The microcontroller 31 issues an instruction to the paper feed motor control unit 34 and drives the paper feed motor 21 so as to rotate the paper feed roller 3, thereby feeding out the sheet 2 from the sheet cassette 1. The fed-out sheet 2 is further conveyed through the conveying path 4. After the front edge of the sheet 2 passed through the first sensor 6, the sheet is conveyed to the resist rollers 5*a* and 5*b*. The first sensor 6 also functions to detect abnormality of the conveyance of the sheet 2. If the front edge or the rear edge of the sheet 2 is not detected by the first sensor 6, the sheet conveyance abnormality is decided.

The resist rollers 5*a* and 5*b* are in the stop state. The sheet 2 is hit against the nip portion of the resist rollers 5*a* and 5*b* and further conveyed by the paper feed roller 3 by a predetermined amount. Thus, the skew operation for correcting the sheet curve or the like is executed. After the skew operation, the microcontroller 31 issues an instruction to the resist motor control unit 35 to drive the resist motor 22, thereby rotating the resist rollers 5*a* and 5*b* and conveying the sheet 2. The microcontroller 31 rotates the resist rollers 5*a* and 5*b* so as to convey the sheet 2 and issues an instruction to the exposure control unit 32 to transmit the operation signal to the LED head 10 so as to irradiate the charged photosensitive drum 8, so that the writing operation is executed on the basis of the inputted image data.

The high voltage power source control unit 36 applies a predetermined voltage to each of the charging unit 9, developing unit 11, transfer roller 12, cleaning unit 13, and fixing unit 14 synchronously with the operation of the photosensitive drum 8, transfer roller 12, and fixing unit 14. That is, the high voltage power source control unit 36 applies the voltage to the charging unit 9 in association with the rotation of the photosensitive drum 8, thereby uniformly charging the surface of the photosensitive drum 8 and applying the charges thereto. The image light is irradiated from the LED head 10 onto the charged photosensitive drum 8 by the operation control by the exposure control unit 32 as mentioned above, so that an electrostatic latent image is formed. When the photosensitive drum 8 is rotated in the direction of an arrow A, the electrostatic latent image reaches the position which faces the developing unit 11. The toner charged with the same polarity as that of the charging electric potential on the surface of the photosensitive drum 8 is adhered on the electrostatic latent image from the developing unit 11 side to which the voltage has been applied, thereby forming a visible image (toner image). The transfer roller 12 to which the voltage has been applied transfers the visible image formed on the surface of the photosensitive drum 8 as mentioned above onto the sheet 2 at the pressure contact point P. The transferred visible image is fixed onto the sheet 2 by the fixing unit 14 set to a predetermined temperature by the voltage supply. The sheet 2 ejected from the fixing unit 14 passes through the third sensor 15, is detected, and is enclosed onto the stacker (not shown). In this manner, the printing is completed.

In the above series of control, control to adjust a conveying speed of the sheet 2 by the resist rollers 5*a* and 5*b* as an essence of the present invention will now be described with reference to a time chart of FIG. 3.

The first sensor 6 detects the passage of the front edge of the sheet 2. The sheet 2 is further conveyed by a predetermined amount from the detection point of time of the front edge of the sheet, its skew correction is made in the nip portion of the resist rollers 5*a* and 5*b*, and the paper feed roller 3 is temporarily stopped. After the elapse of a predetermined time, the resist rollers 5*a* and 5*b* are rotated and the exposure writing operation of the image data of one page is started on the photosensitive drum 8 synchronously with the rotation.

When the conveyance of the sheet 2 is started by rotating the resist rollers 5*a* and 5*b*, the exposure writing operation is started synchronously with it. When it is detected that the front edge of the sheet 2 has passed through the second sensor 7, in the microcontroller 31 of the control apparatus 30, a time t2 which is required until the front edge of the sheet is detected after the start of the rotation of the resist rollers 5*a* and 5*b* is measured by a timer interrupting process and a delay amount Ld (mm) of the sheet conveyance is calculated by the following equation (1) on the basis of the measured time t2.

$$Ld=(t2-T2)\times V1 \quad (1)$$

where,

T2 (sec): set time which is required until the front edge of the sheet 2 is detected by the second sensor 7 after the start of the writing onto the photosensitive drum 8 by the exposure That is, T2 denotes a value of the time which is required until the sheet 2 is ideally conveyed by a distance L2 between the resist rollers 5*a* and 5*b* and the second sensor 7 in correlation with a peripheral speed of the drum rotation when the photosensitive drum 8 is forwardly rotated counterclockwise as shown by the arrow A. The time value T2 can be preliminarily and empirically obtained and it is assumed that it is managed in a data table format and has been stored in a set value storing memory 37 (refer to FIG. 2).

V1 (mm/sec): rotational peripheral speed of the photosensitive drum 8; that is, normal sheet conveying speed of the resist rollers 5*a* and 5*b*

Figure 3:
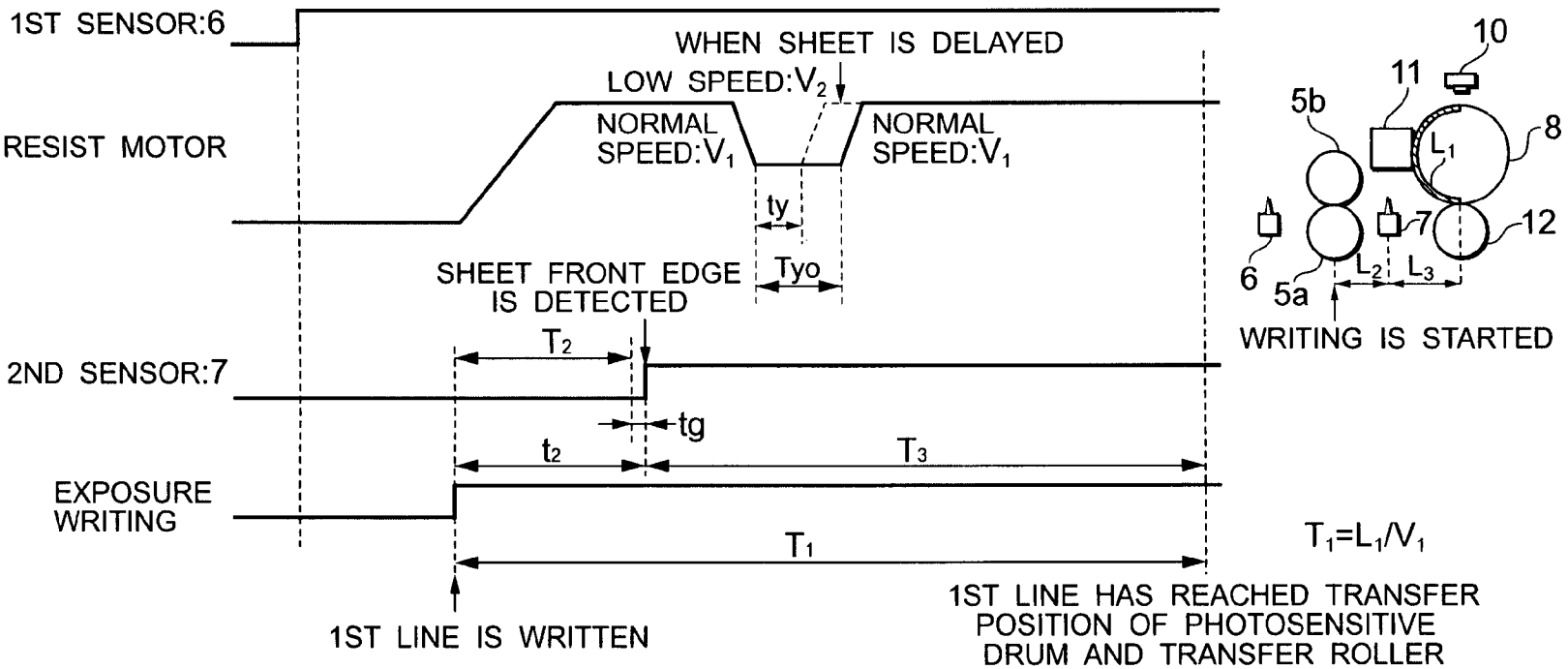
FIG. 3 is a time chart showing the sequence operation in the embodiment 1.

In the equation (1), when the calculated delay amount of the sheet conveyance is equal to 0 (Ld=0), that is, when no time delay occurs in the sheet conveyance, as shown in FIG. 3, the sheet 2 is conveyed by a set time TyO (sec) so that a conveyance amount of the sheet 2 is equal to a set value LyO (mm) at a low speed V2 (mm/sec) obtained by temporarily setting the sheet conveying speed according to the rotational speed of the resist rollers 5*a* and 5*b* which are rotated by the resist motor 22 to a value for adjustment. A correlation among the sheet conveyance delay amount Ld, the sheet conveyance amount by the low speed V2, and the set time has also been stored in the data table format in the set value storing memory 37. Therefore, after the sheet has been conveyed at the low speed V2 by the set time TyO (sec) corresponding to the predetermined conveyance amount LyO, the sheet conveying speed is returned to the normal speed V1 (mm/sec) again and the sheet is conveyed to the transfer roller 12.

When the calculated delay amount of the sheet conveyance lies within a range of (0<Ld≦Lz), that is, when a time delay tg occurs in the sheet conveyance, the sheet conveyance amount at the low speed V2 is reduced by the sheet delay amount. That is, the sheet 2 is conveyed by a set time ty in order to reduce the conveyance amount at the low speed V2 by Ly (mm)=LyO−Ld. After the sheet has been conveyed in this manner, the sheet conveying speed is returned to the normal speed V1 again and the sheet is conveyed to the transfer roller 12. Lz denotes a limit value of the sheet conveyance delay in which the sheet conveyance delay amount Ld at the low speed V2 cannot be made to coincide with the transfer start position at the pressure contact point P of the transfer roller 12.

When the calculated delay amount of the sheet conveyance is smaller than 0 (Ld<0), that is, when the sheet conveyance is advanced with respect to time, the sheet conveyance amount at the low speed V2, that is, the set time ty is set to be larger than TyO (sec). By this setting, after the sheet has been conveyed, the sheet conveying speed is returned to the normal speed V1 again and the sheet is conveyed to the transfer roller 12.

When the calculated delay amount of the sheet conveyance lies within a range of (0<Ld≦Lz), that is, when a time delay tg occurs in the sheet conveyance, the sheet conveyance amount at the low speed V2 is reduced by the sheet delay amount. That is, the sheet 2 is conveyed by a set time ty in order to reduce the conveyance amount at the low speed V2 by Ly (mm)=LyO−Ld. After the sheet has been conveyed in this manner, the sheet conveying speed is returned to the normal speed V1 again and the sheet is conveyed to the transfer roller 12. Lz denotes a limit value of the sheet conveyance delay in which the sheet conveyance delay amount Ld at the low speed V2 cannot be made to coincide with the transfer start position at the pressure contact point P of the transfer roller 12.

When the calculated delay amount of the sheet conveyance is smaller than 0 (Ld<0), that is, when the sheet conveyance is advanced with respect to time, the sheet conveyance amount at the low speed V2, that is, the set time ty is set to be larger than TyO (sec). By this setting, after the sheet has been conveyed, the sheet conveying speed is returned to the normal speed V1 again and the sheet is conveyed to the transfer roller 12.

On the other hand, the timing to start the paper feed is determined as follows. When the second sensor 7 detects the front edge of the sheet 2, it sends a detection signal to the resist motor control unit 35 of the control apparatus 30 so that an operation signal is generated from the resist motor control unit 35, thereby driving the resist motor 22 and rotating the resist rollers 5*a* and 5*b*. The resist motor control unit 35 has a pulse counter and counts the number of clocks, that is, phase switching pulses of the resist motor 22 in this instance by the pulse counter. When a count value reaches a predetermined number (N) of clocks, the resist motor control unit 35 notifies the microcontroller 31 of it. The microcontroller 31 uses this notification as paper feed start timing and starts the paper feed. In the microcontroller 31, the predetermined number (N) of clocks is recognized by a method whereby a size of sheets 2 enclosed in the sheet cassette 1 is detected by a sheet size detecting sensor (not shown). The number (N) of clocks is determined with reference to the sheet size information which has previously been stored in a management table format in the set value storing memory 37. The number (N) of clocks is set into the resist motor control unit 35.

When the next print instruction is received for a period of time from the paper feed start timing to the completion of the sheet ejection, the series of operations in a range from the paper feed start operation to the end of the sheet ejection is executed. If the print instruction is not received until the paper feed start timing and the sheet 2 which is being printed is ejected, the drive control by the main driving motor control unit 33 is stopped and the rotation of the main driving motor 20 is stopped.

Figure 4:
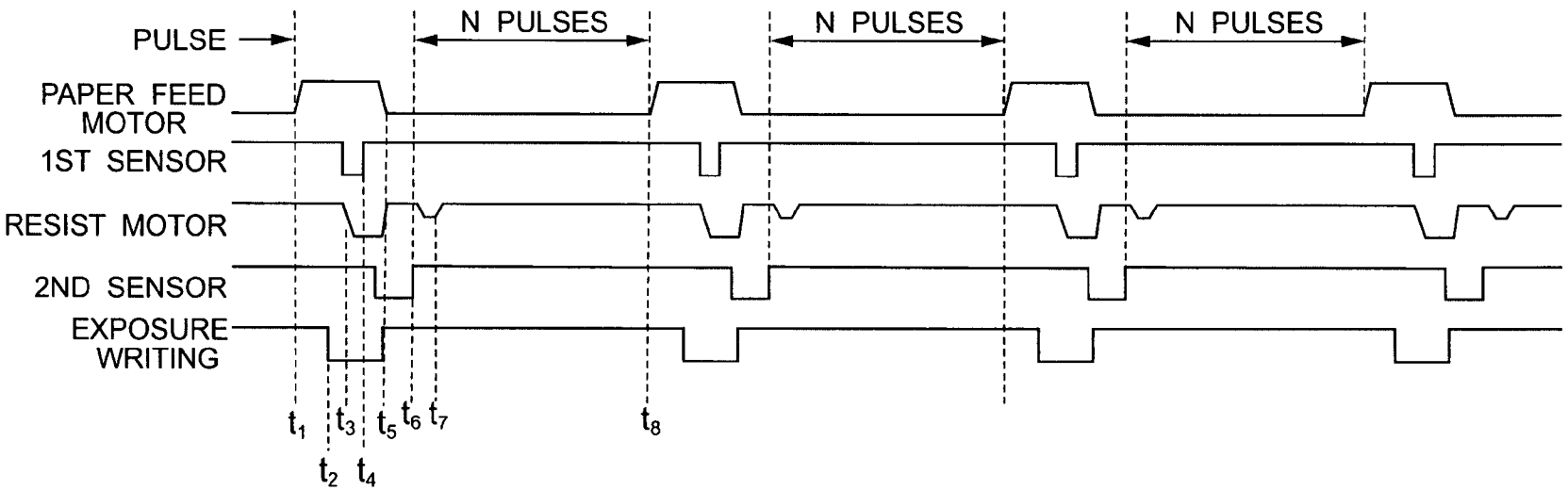
FIG. 4 is a time chart showing the continuous printing operation in the embodiment 1.

FIG. 4 is a time chart for the continuous printing operation which repeats the series of operations in the range from the paper feed start operation to the sheet ejection if the next print instruction is continuously received until the paper feed start timing.

First, when the preceding sheet 2 is conveyed by a predetermined amount corresponding to (N) pulses by the resist roller on the basis of the sheet size information read out from the set value storing memory 37, the paper feed motor 21 is driven. By starting the rotation of the paper feed roller 3, the subsequent next sheet 2 is fed out of the sheet cassette 1 (t1). Subsequently, the predetermined exposure writing operation to the preceding sheet 2 is finished and the driving is stopped (t2). When the rear edge of the preceding sheet 2 is detected by the first sensor 6, the conveyance of the sheet 2 is continued by a predetermined amount from there, thereafter, the driving of the resist motor 22 is stopped, and the rotation of the resist rollers 5*a* and 5*b* is stopped (t3). For this period of time, if the front edge of the subsequent fed-out sheet 2 passes through the first sensor 6 and is detected, the subsequent sheet 2 is pushed by the paper feed roller 3 after that and the skew correction is made by the resist rollers 5*a* and 5*b* (t4). After that, the rotation of the paper feed roller 3 is stopped, the subsequent sheet 2 is conveyed by the resist rollers 5*a* and 5*b*, and the exposure writing operation is started (t5). Subsequently, when the front edge of the subsequent sheet 2 passes through the second sensor 7 and is detected, the conveyance amount at the low speed V2 is calculated, the resist rollers 5*a* and 5*b* are rotated at the low speed on the basis of the calculated low speed conveyance amount, and the sheet is conveyed (t6-t7). After the low speed conveyance, the sheet conveying speed is returned to the normal speed, the resist rollers 5*a* and 5*b* are rotated, and the sheet is conveyed (t7-t8). After the sheet has been conveyed by driving the resist motor 22 by the amount corresponding to (N) pulses obtained from the sheet size information regarding the subsequent sheet 2, the paper feed roller 3 is rotated to feed out the subsequent sheet 2 from the sheet cassette 1 and convey it (t8). The sequence operation by (t1) to (t8) mentioned above is repeated.

The case where the sheet conveyance delay amount Ld (mm) is larger than Lz (limit value) (Ld>Lz) will now be described.

Figure 5:
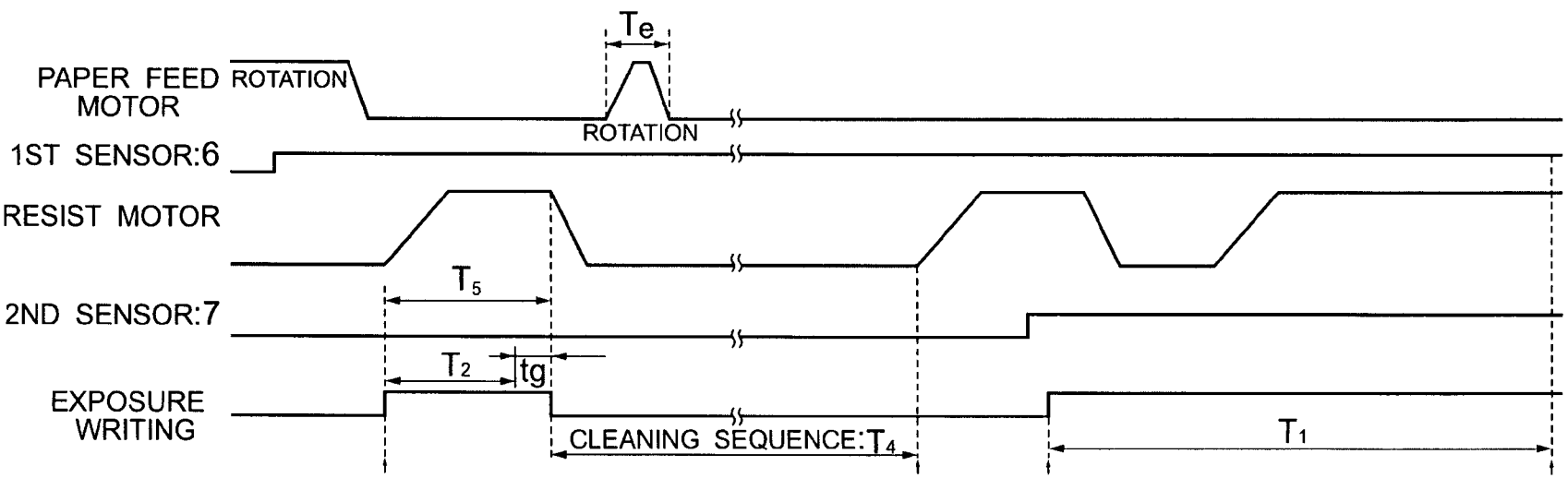
FIG. 5 is a time chart showing a cleaning sequence in the embodiment 1.

As shown in FIG. 5, when the resist motor is driven after completion of the skew correction and the rotation of the resist rollers 5*a* and 5*b* is started, the exposure writing operation is started synchronously with the rotation as mentioned above.

When the driving of the resist motor is started and a predetermined set time T5 elapses without receiving the detection signal from the second sensor 7, the microcontroller 31 calculates the delay amount Ld (mm) corresponding to the conveyance delay time tg on the basis of the equation (1). Since the delay amount is (Ld>Lz), the sheet 2 cannot be made to coincide with the transfer start position at the low speed V2. Therefore, the following control is made.

Figure 6:
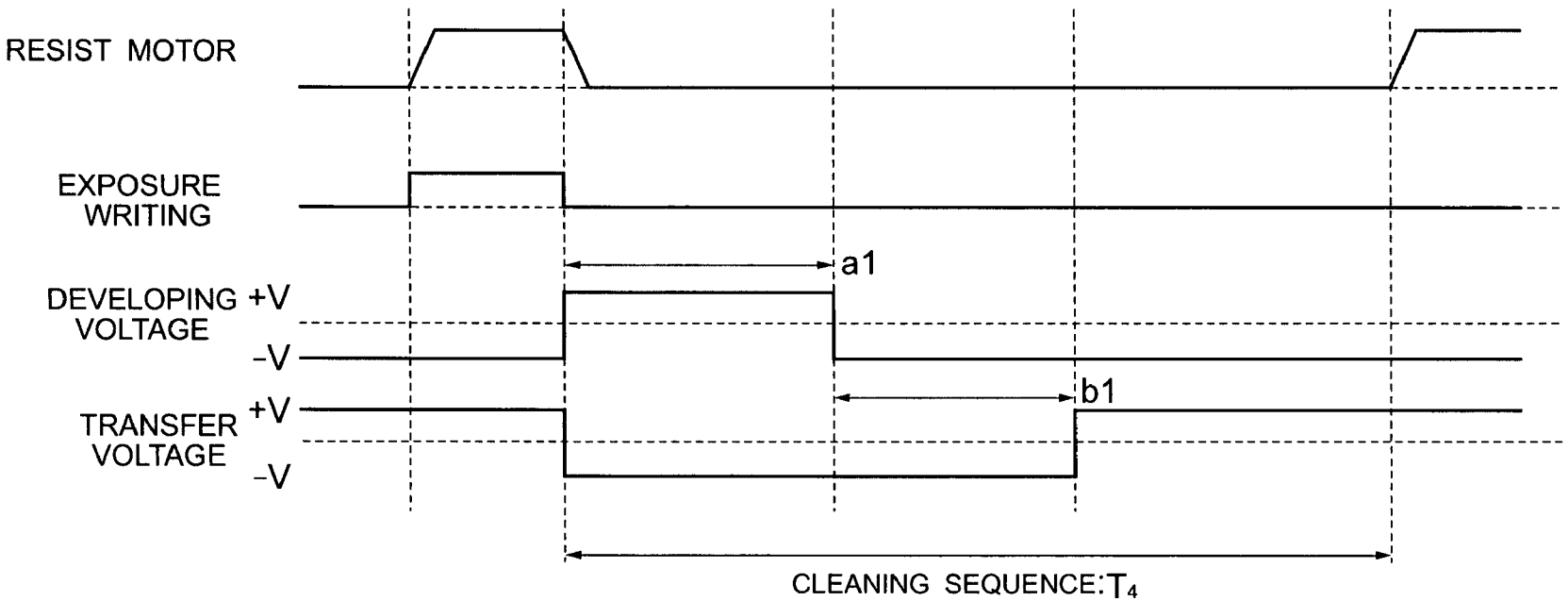
FIG. 6 is a time chart showing a relation between the cleaning sequence and an applied voltage in the embodiment 1.

That is, the microcontroller 31 supplies a stop signal to each of the resist motor control unit 35 and the exposure control unit 32 as shown in FIGS. 5 and 6. Thus the rotation of the resist rollers is stopped, the driving of the LED head 10 is stopped, and the exposure is stopped.

Further, the microcontroller 31 supplies a stop signal of the development and the transfer to the high voltage power source control unit 36. The high voltage power source control unit 36 applies voltages of opposite polarities to the developing unit 11 and the transfer roller 12 as shown in FIG. 6. Thus, the adhesion of the toner to the electrostatic latent image portion which has already been formed on the photosensitive drum 8 is prevented and it is possible to prevent the toner from being adhered onto the transfer roller 12 from the toner-adhered developing portion on the photosensitive drum 8. In association with the rotation of the photosensitive drum 8, the toner in the developing portion is collected by the cleaning unit 13.

Subsequently, when a non-exposure portion of the photosensitive drum reaches the developing position, the high voltage power source control unit 36 starts to apply a developing voltage of the ordinary polarity to the developing unit (a1). When the non-toner exposure portion of the photosensitive drum reaches the transfer position, the high voltage power source control unit 36 starts to apply a transfer voltage of the ordinary polarity to the transfer unit (b1). After that, the exposed portion of the photosensitive drum 8 passes through the charging unit 9 and reaches the LED head 10, so that the exposure can be performed. A period from the stop of the exposure to the state where the exposure can be performed is shown as a cleaning sequence T4 in FIGS. 5 and 6.

After the resist motor 22 has been stopped, the microcontroller 31 supplies a driving signal to the paper feed motor control unit 34, thereby previously rotating the paper feed roller 3 by a time Te (sec) as shown in FIG. 5. When the end of the cleaning sequence T4 (the exposure is possible) is detected, the microcontroller 31 supplies a driving signal to the resist motor control unit 35. Thus, the rotation of the resist rollers 5*a* and 5*b* is started. When the front edge of the sheet 2 is detected by the second sensor 7, the microcontroller 31 supplies a driving signal to the exposure control unit 32, thereby driving the LED head 10. Thus, the creation of the electrostatic latent image on the photosensitive drum 8 from the first line is started.

When the creation of the electrostatic latent image is started as mentioned above, the microcontroller 31 rotates the resist rollers 5*a* and 5*b* by a predetermined amount, thereafter, temporarily stops the sheet conveyance by the resist rollers by stopping the resist motor, drives the resist motor again after the elapse of a set time, and rotates the resist rollers so that the conveying speed is equal to V1.

It is also possible to construct the apparatus in such a manner that when the state of (Ld>Lz) occurs continuously, for example, five times, the microcontroller 31 is allowed to determine that the conveyance abnormality has occurred and display a message indicative of the abnormality.

In the embodiment, in the set value storing memory 37, it is also possible to make the set time ty of the set low speed V2 for adjustment correspond to the difference tg between the measured delay time t2 and the ideal time T2 (tg=0→ty0). In this case, the arithmetic operation of the equation (1) is unnecessary. In this instance, it is preferable to set the limit delay time Tz corresponding to Lz (mm) and discriminate whether or not (tg>T2).

Effects of Embodiment 1

As mentioned above, the exposure writing operation is started synchronously with the rotation start of the resist rollers without being synchronized with the detection timing of the second sensor and the time ty for driving the resist rollers at the set low speed V2 for adjustment is controlled. Therefore, the printing process can be executed in a short time while accurately making the transfer start position of the sheet coincide with the exposure start position of the first line of the photosensitive drum.

In the embodiment, the feeding of the next sheet from the cassette is started at the point of time when the (N) pulses are supplied to the resist motor instead of the point of time when the rear edge of the sheet is detected by the first sensor, so that the rotation start timing of the resist rollers becomes early. Therefore, the printing process can be executed at a high speed by making exposure start timing earlier. Since the operation in which the conveyance of the recording medium is stopped and the medium is conveyed is not executed, a sound which is caused when the recording medium is stopped and conveyed again is not generated.

Further, when the sheet delay amount cannot be corrected even if the resist motor is driven at the set low speed V2, such a state is not determined to be a jam but the foregoing cleaning sequence operation is executed and the exposure and the conveyance are executed again, so that a deterioration in printing efficiency can be also prevented. In other words, if such a state is determined to be the jam, the troublesome operations in which the user opens a cover and removes the sheet and the like are necessary. In the embodiment, however, the jam and the conveyance delay of the sheet can be clearly discriminated and the printing process can be executed.

Embodiment 2

Construction of Embodiment 2

The embodiment 2 as an application example of the embodiment 1 mentioned above will now be described with reference to FIGS. 7 and 8. Component elements common to those of the units and apparatuses of the embodiment 1 are designated by the same reference numerals and their detailed description is omitted here.

Figure 7:
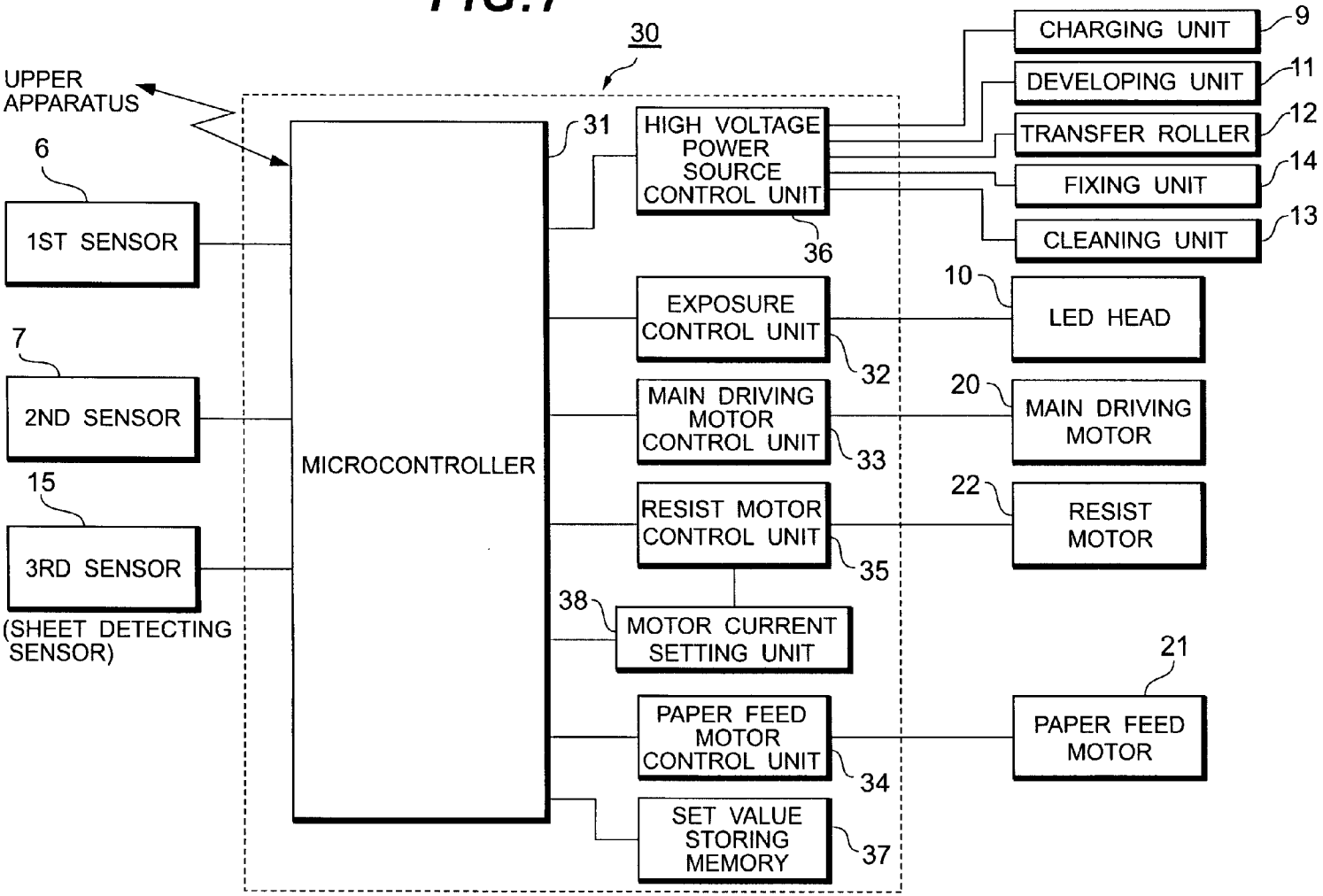
FIG. 7 is a functional block diagram showing a mechanism control unit according to the embodiment 2.

As shown in a functional block diagram of FIG. 7, a motor current setting unit 38 is newly provided for the control apparatus 30 and connected to the microcontroller 31. The motor current setting unit 38 is connected to the microcontroller 31 and also connected to the resist motor control unit 35. For example, a D/A converter can be used as a motor current setting unit 38. The motor current setting unit 38 receives an instruction signal from the microcontroller 31 and varies an output voltage (output current) to the resist motor control unit 35. The resist motor control unit 35 changes a phase current value of the motor on the basis of an output of the motor current setting unit 38.

Operation of Embodiment 2

Figure 8:
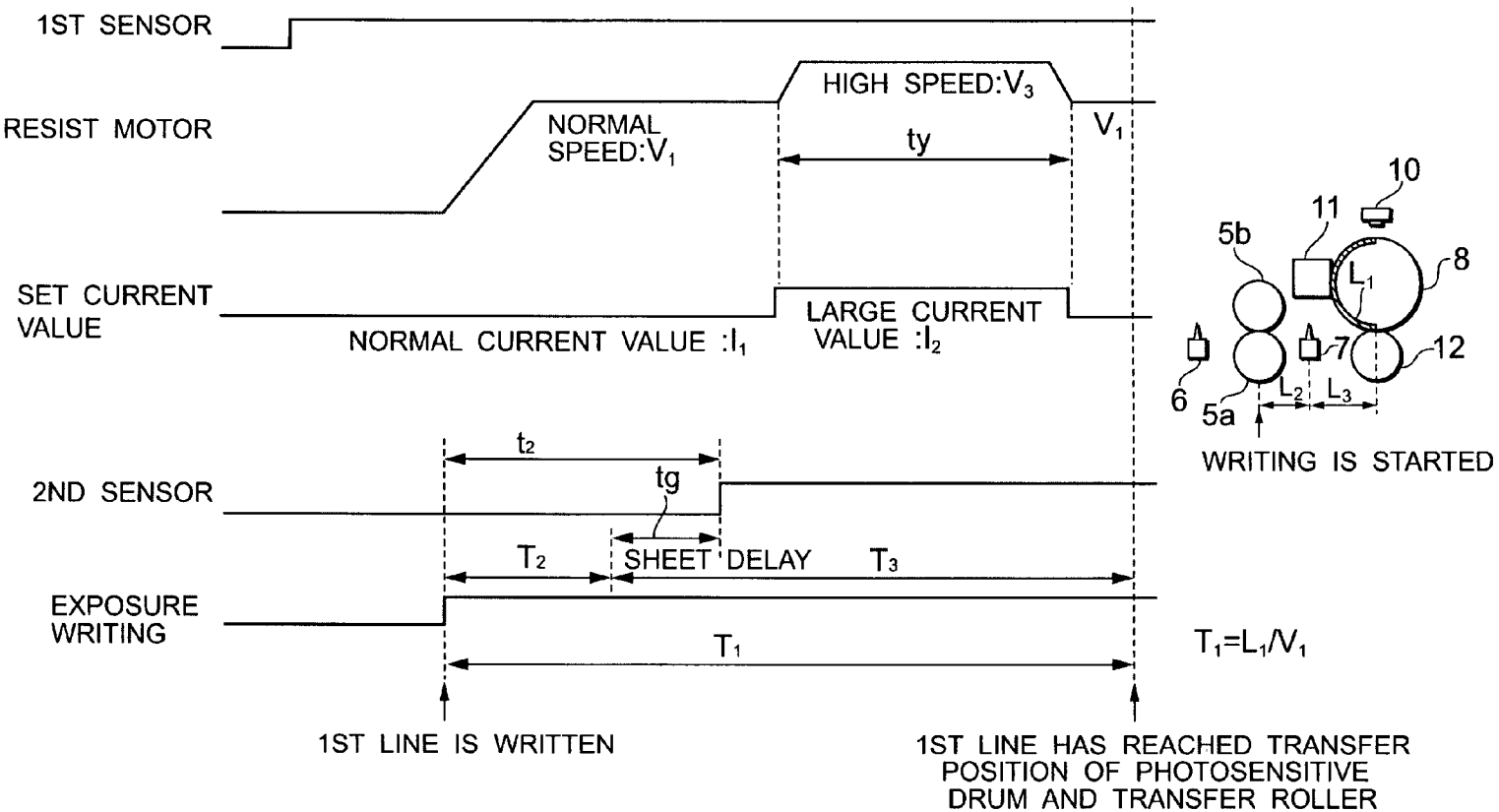
FIG. 8 is a time chart showing the sequence operation in the embodiment 2.

By the above construction, as shown in a time chart of FIG. 8, the following operation is executed in this embodiment. As described in the embodiment 1, the exposure writing operation is started almost synchronously with the start of the rotation of the resist rollers 5*a* and 5*b*. When the front edge of the sheet passes through the second sensor 7, it is detected. In the microcontroller 31 of the control apparatus 30, the time t2 which is required until the front edge of the sheet 2 is detected by the second sensor 7 after the start of the rotation of the resist rollers 5*a* and 5*b* is measured. On the basis of the measured time t2, the delay amount Ld (mm) of the sheet conveyance is calculated by the equation (1)

$$Ld=(t2-T2)\times V1 \quad (1)$$

When the calculated sheet conveyance delay amount Ld is (Ld≧Lz), that is, if the exposure writing position at the pressure contact point on the transfer roller 12 cannot be made coincide by conveying the sheet at the low speed V2 with the sheet conveyance delay, the output voltage to the resist motor control unit 35 is changed under the control of the motor current setting unit 38. By this method, the current set value of the resist motor 22 is set to a large current value I2 (A) for rotating the rollers at a high speed and the sheet is conveyed at a high speed V3 (mm/sec) by the set time ty corresponding to the delay amount Ld (mm) of the sheet conveyance. After that, the sheet conveying speed is returned to the normal conveying speed V1 (mm/sec) again and the sheet is conveyed to the transfer roller 12.

Effects of Embodiment 2

According to the embodiment 2, when the sheet delay amount upon sheet conveyance by the resist rollers 5*a* and 5*b* is large, the resist rollers are rotated at the high speed and the sheet is conveyed. Therefore, a control response speed is raised against the sheet delay and the printing efficiency can be further improved.

Construction of Embodiment 3

Figure 9:
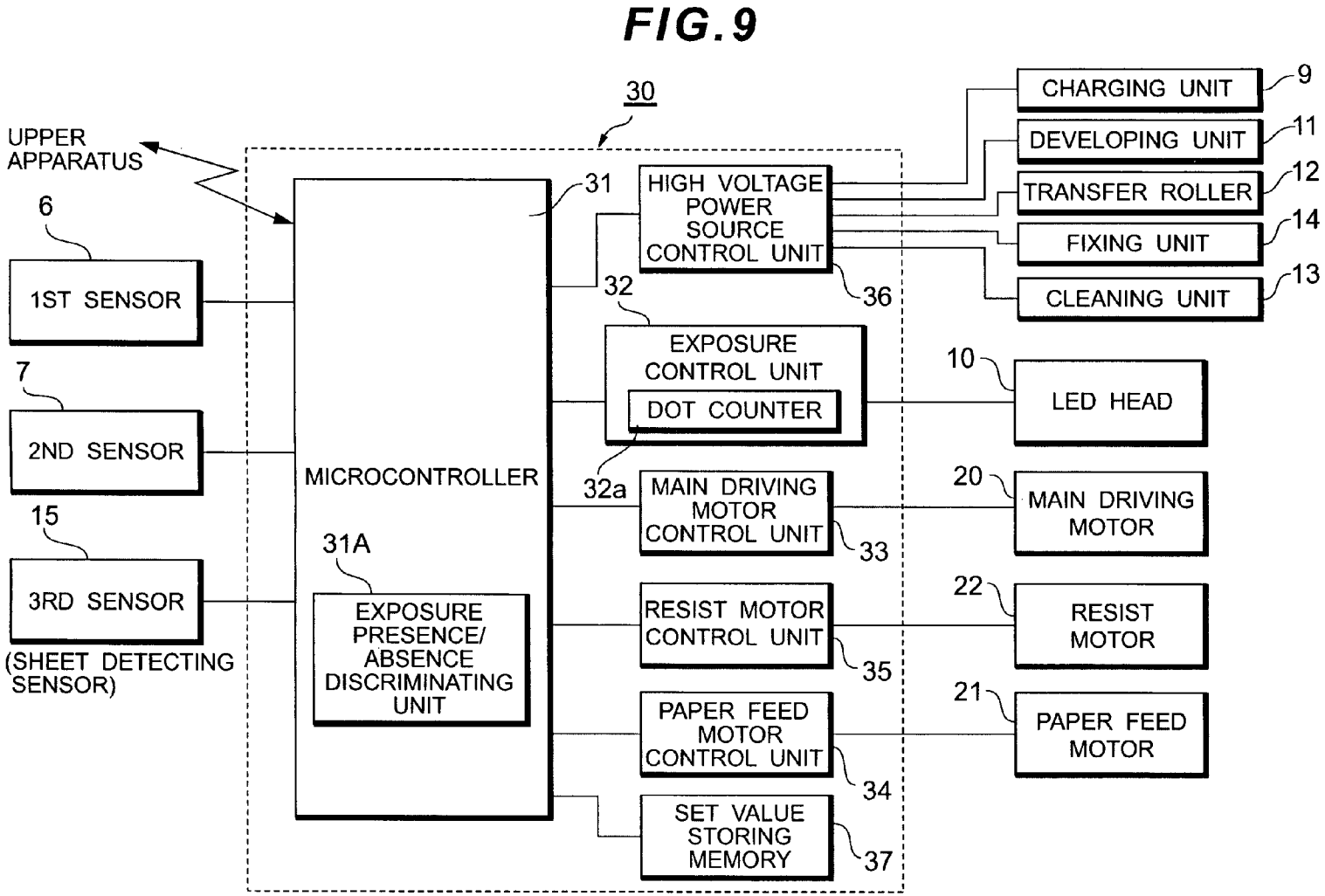
FIG. 9 is a block diagram showing a mechanism control unit according to the embodiment 3.

FIG. 9 is a block diagram of a mechanism control unit according to the embodiment 3. In the mechanism control unit, the exposure control unit 32 has a dot counter 32*a* and the microcontroller 31 has an exposure presence/absence discriminating unit 31A. Other constructions in the embodiment 3 are substantially the same as those in the embodiment 1 (FIGS. 1 and 2).

When the exposure control unit 32 supplies dot (black) data to the LED head 10, the dot counter 32*a* counts the number of dot data. When the sheet conveyance delay amount Ld is larger than the limit amount Lz, the exposure presence/absence discriminating unit 31A fetches a count value of the dot counter 32*a* at the time of stopping the exposure by the exposure control unit 32. When the count value exists, the presence of the exposure is determined. If the count value="0", the absence of the exposure is determined. If the exposure exists, the microcontroller 31 makes the cleaning sequence control (refer to FIG. 6) as mentioned above. If there is no exposure, the start of the exposure is controlled without making the cleaning sequence control.

The operation of the image recording apparatus of this embodiment will now be described.

The skew correction of the sheet 2 is made in the nip portion of the resist rollers 5*a* and 5*b* in the stop state. After that, when the resist motor 22 is driven and the resist rollers 5*a* and 5*b* are rotated, the dot data of one page is sequentially supplied from the exposure control unit 32 to the LED head 10 synchronously with it. The exposure to the photosensitive drum 8 is started. The counting operation of the dot counter 32*a* to count the number of dot data is started in response to the start of the exposure. When the front edge of the sheet 2 is detected by the second sensor 7, the microcontroller 31 measures the time t2 which is required until the front edge of the sheet is detected after the start of the rotation of the resist motor, executes the arithmetic operation of the equation (1), and calculates the conveyance delay amount Ld (mm).

When Ld=0, the sheet 2 is conveyed by the amount TyO (sec) at the set speed V2 for adjustment as mentioned above. If Ld<Lz because of the delay of the conveyance of the sheet 2, the sheet 2 is conveyed by ty (sec) at the low speed V2. Therefore, the exposure start position of the photosensitive drum 8 accurately coincides with the transfer start position of the sheet 2.

When the exposure to the photosensitive drum 8 is continued as mentioned above, the exposure control unit 32 resets the count value of the dot counter 32*a* to "0" and stops the operation.

When the number of clocks of the resist motor 22 reaches (N), the next sheet is fed out of the cassette 1 as mentioned above.

The case where the delay amount Ld (mm) of the sheet conveyance is (Ld>Lz (limit value)) will now be described.

The microcontroller 31 calculates Ld by the equation (1) on the basis of the predetermined set time T5 without receiving the detection signal. When (Ld>Lz) is discriminated, the microcontroller 31 outputs the stop signal to each of the resist motor control unit 35 and the exposure control unit 32 as shown in FIG. 5. Thus, the rotation of the resist rollers is stopped, the driving of the LED head 10 is stopped, and the exposure is stopped.

When the exposure control unit 32 receives the stop signal, it outputs the count value of the dot counter 32*a* to the microcontroller 31, resets the count value of the dot counter 32*a* to "0", and stops the operation.

In the microcontroller 31, if the count value is equal to a numerical value other than "0", since the electrostatic latent image has already been formed on the photosensitive drum 8, the exposure presence/absence discriminating unit 31A determines the presence of the exposure.

Thus, the microcontroller 31 starts the cleaning sequence control and supplies the stop signal of each of the development and the transfer to the high voltage power source control unit 36, so that the voltages of the opposite polarities are applied to the developing unit 11 and the transfer roller 12 as shown in FIG. 6. Thus, the adhesion of the toner to the electrostatic latent image portion which has already been formed on the photosensitive drum 8 is prevented and the toner is prevented from being adhered onto the transfer roller 12 from the developing unit on the photosensitive drum 8. In association with the rotation of the photosensitive drum 8, the toner in the developing unit is collected by the cleaning unit 13.

Subsequently, the high voltage power source control unit 36 starts to apply the developing voltage to the developing unit at the time point a1 and starts to apply the transfer voltage to the transfer unit at the time point b1. When the exposed portion of the photosensitive drum 8 passes through the charging unit 9 and reaches the LED head 10 again, the exposure can be performed. The cleaning sequence control is finished.

After the resist motor 22 has been stopped, the microcontroller 31 supplies the driving signal to the paper feed motor control unit 34, thereby rotating the paper feed roller 3 by the set time Te (sec). When the cleaning sequence control is finished, the microcontroller 31 drives the resist motor 22. When the front edge of the sheet 2 is detected by the second sensor 7, the microcontroller 31 drives the LED head 10 through the exposure control unit 32, thereby starting the exposure.

After that, the microcontroller 31 rotates the resist rollers by the predetermined amount, thereafter, temporarily stops the resist motor 22, adjusts the exposure start position of the sheet, and drives the resist motor again.

When the received count value is equal to "0", since no electrostatic latent image is formed on the photosensitive drum 8, the exposure presence/absence discriminating unit 31A determines the absence of the exposure. When the count value is equal to "0", this means that the printing of a few lines is not executed on the sheet 2.

Figure 10:
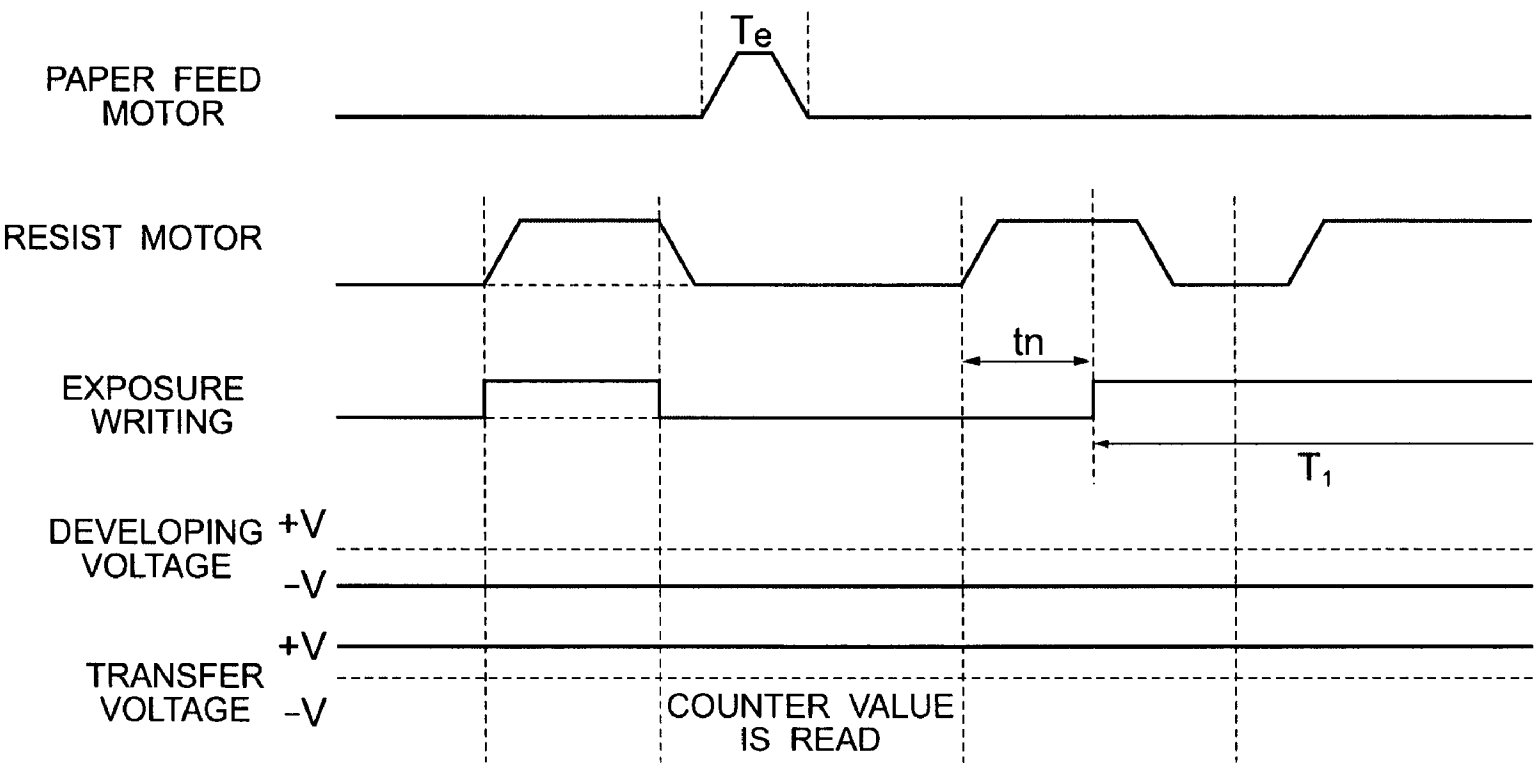
FIG. 10 is a timing chart of a counter value "0" in the embodiment 3.
Figure 11:
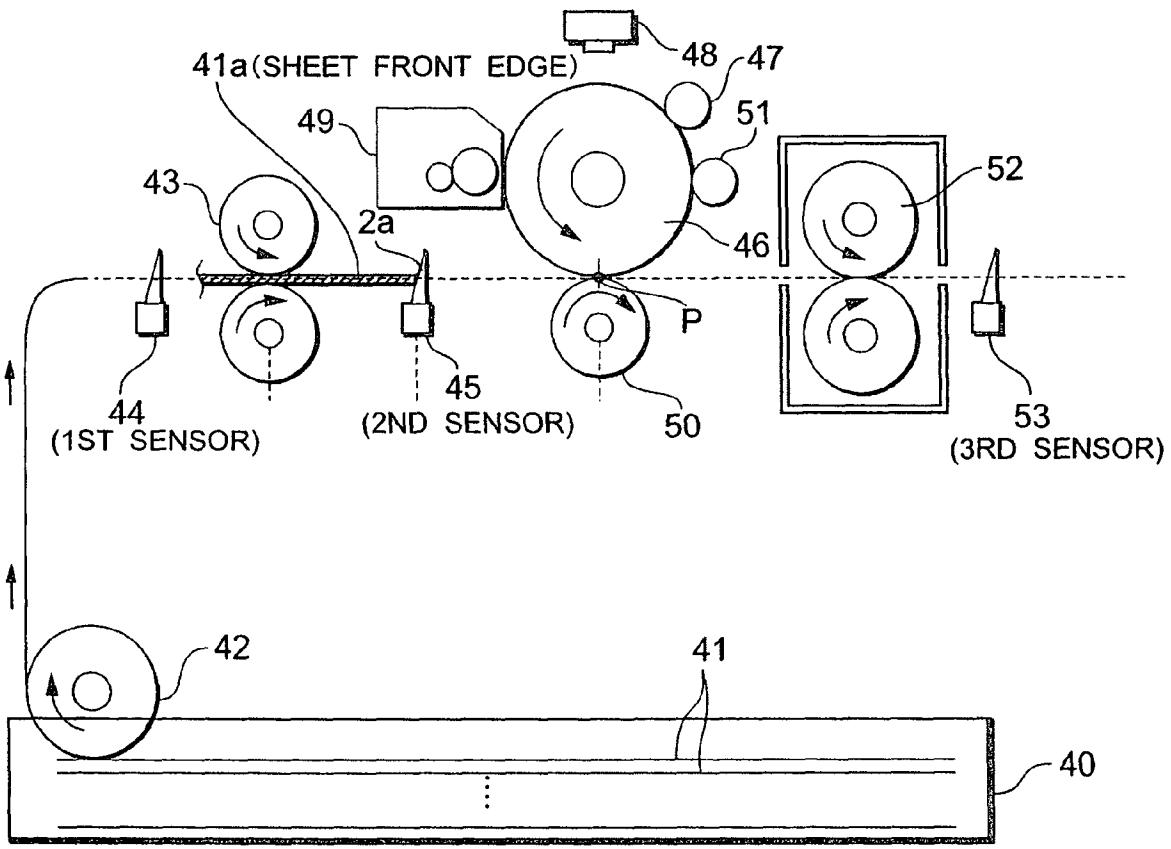
FIG. 11 (PRIOR ART)
FIG. 11 is a side elevational view of an apparatus for use in explanation of a conventional structure.
Figure 12:
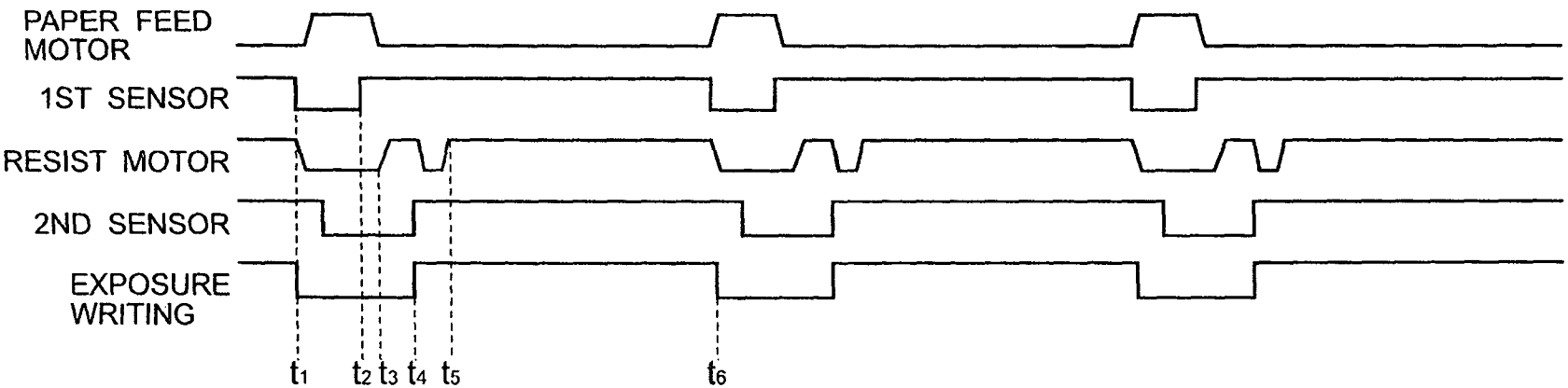
FIG. 12 (PRIOR ART)
FIG. 12 is a time chart showing the conventional continuous printing operation.

Thus, as shown in FIG. 10, the microcontroller 31 does not make the cleaning sequence control but immediately supplies the driving signal to the paper feed motor control unit 34 in the state where the developing voltage and the transfer voltage have been applied as they are, thereby rotating the paper feed roller 3 by the set time Te (sec). After the elapse of the set time, the resist motor 22 is driven. When the front edge of the sheet 2 is detected by the second sensor 7, the microcontroller 31 drives the LED head 10 through the exposure control unit 32, thereby starting the exposure.

After that, the microcontroller 31 temporarily stops the resist motor 22, make adjustment with the exposure start position of the sheet, and drives the resist motor 22 again.

As mentioned above, if no electrostatic latent image is formed on the photosensitive drum, the exposure is immediately started without making the cleaning sequence control, so that the printing speed can be further raised.

The present invention is not limited to the foregoing embodiments but many modifications and variations are possible within the spirit and scope of the appended claims of the invention.

What is claimed is:

1. An image recording apparatus having an image holding material which is charged and rotated and is exposed by an exposing unit and on which an electrostatic latent image is formed, a developing unit which adheres toner onto said electrostatic latent image on said image holding material, a medium feeding unit which feeds out a recording medium, a conveying unit which is driven by a driving unit after a skew of said fed-out recording medium is corrected and which conveys said recording medium toward a transfer position, and a transfer unit which transfers said toner adhered on said image holding material onto said recording medium which is arranged at said transfer position and is conveyed, comprising:

an exposure control unit which drives said exposing unit on the basis of said driving of said conveying unit;

a medium detecting unit which is arranged between said conveying unit and said transfer position and outputs a detection signal when a front edge of said conveyed recording medium is detected; and a conveying speed control unit which measures a time which is required until said detection signal is received after said driving of said conveying unit is started, sets a conveying speed of said conveying unit in order to allow an exposure start position of said image holding material to coincide with a transfer start position of said recording medium at said transfer position on the basis of a time difference between said measured time and a set time, and controls said driving unit wherein:

said conveying speed control unit sets the same conveying speed as a peripheral speed of said image holding material into said conveying unit, sets a low speed for adjustment lower than said conveying speed, sets an adjustment time for driving said conveying unit at said low speed in correspondence to the time difference between said measured time and said set time, and discriminates whether or not said low speed can be set on the basis of said time difference, and said apparatus further comprises:

a cleaning sequence control unit which, if said conveying speed control unit determines that the setting of said low speed is impossible, stops said driving unit, controls said exposure control unit so as to stop the driving of said exposing unit, stops supply of a developing voltage to said developing unit for a predetermined time so as to prevent the toner from being adhered onto the electrostatic latent image formed on said image holding material, and stops supply of a transfer voltage for a predetermined time so as to prevent the toner adhered on said image holding material from being transferred to said transfer unit;

an exposure re-driving control unit which controls said exposure control unit so as to drive said exposing unit again when the stop of the supply of said developing voltage and the stop of the supply of said transfer voltage are cancelled; and a re-conveyance control unit which sets the conveying speed of said conveying unit in correspondence to the re-driving of said exposing unit and controls said driving unit.

2. The image recording apparatus according to claim 1, wherein said exposure control unit has a dot counter which counts the number of dot data which is supplied to said exposing unit in order to form the electrostatic latent image, and said apparatus further comprises exposure discrimination activating unit which, if said conveying speed control unit determines that the setting of said low speed is impossible, fetches a count value of said dot counter, if said count value is equal to "0", stops said driving unit without activating said cleaning sequence control unit, controls said exposure control unit so as to stop the driving of said exposing unit, and activates said exposure re-driving control unit and said re-conveyance control unit.

3. An image recording control method of forming an electrostatic latent image onto an image holding material which is charged and rotated by exposing said image holding material by an exposing unit, adhering toner onto said electrostatic latent image by a developing unit, conveying a fed-out and skew-corrected recording medium to a transfer position by a conveying unit, and transferring said adhered toner onto said recording medium by a transfer unit at said transfer position, comprising the steps of:

allowing said exposing unit to start the exposure on the basis of driving of said conveying unit;

if medium detecting unit arranged between said conveying unit and said transfer position detects a front edge of said recording medium, measuring a time which is required until said front edge is detected after the driving of said conveying unit is started; and setting a conveying speed for allowing an exposure start position of said image holding material to coincide with a transfer start position of said recording medium at said transfer position on the basis of a time difference between said measured time and a set time and driving said conveying unit at said conveying speed, wherein:

the same conveying speed as a peripheral speed of said image holding material and a low speed for adjustment lower than said conveying speed are set into said conveying unit;

an adjustment time corresponding to the time difference between said measured time and said set time is discriminated and said conveying unit is driven at said low speed for said adjustment time;

whether or not the setting of said low speed is possible is discriminated on the basis of said time difference, and if the setting of said low speed is impossible, said conveying unit and said exposing unit are stopped;

supply of a developing voltage to said developing unit is stopped for a predetermined time so as to prevent the toner from being adhered onto the electrostatic latent image formed on said image holding material and supply of a transfer voltage is stopped for a predetermined time so as to prevent the toner adhered on said image holding material from being transferred to said transfer unit; and said exposing unit is driven again when the stop of the supply of said developing voltage and the stop of the supply of said transfer voltage are cancelled and the conveying speed of said conveying unit is controlled in correspondence to said re-driving.

4. The image recording apparatus according to claim 1, further comprising:

a normal speed; and an adjusting speed that is substantially different than said normal speed to facilitate conveying said recording medium from said conveying unit to said transfer position, said adjusting speed is used during the use of said normal speed, wherein said conveying speed control unit controls said conveying unit at said normal speed until said detection signal is received, determines a time period to use said adjusting speed by measuring a time difference between a pre-determined time and an actual time require until said detection signal is received after said conveying unit is started to drive, controls said conveying unit at said adjusting speed for said time period, and controls said conveying unit at said normal speed at the end of said time period to facilitate continuously conveying said recording medium.

5. The image recording control method according to claim 3, further comprising:

driving said conveying unit at a normal speed;

driving said conveying unit at an adjusting speed that is substantially different than said normal speed to facilitate conveying said recording medium from said conveying unit to said transfer position, wherein said adjusting speed is used during the use of said normal speed;

controlling said conveying unit at said normal speed until a detection signal is received;

determining a time period to use said adjusting speed by measuring a time difference between a pre-determined time and an actual time require until said detection signal is received after said conveying unit is started to drive;

controlling said conveying unit at said adjusting speed for said time period; and controlling said conveying unit at said normal speed at the end of said time period to facilitate continuously conveying said recording medium.

6. The image recording apparatus according to claim 1, wherein said exposing unit is started synchronously with the starting of said conveying unit.

7. The image recording apparatus according to claim 1, wherein said electrostatic latent image is developed and is transferred directly from said image holding material onto the recording medium.

8. The image recording control method according to claim 3, wherein said exposing unit is started synchronously with the starting of said conveying unit.

9. The image recording control method according to claim 3, wherein said electrostatic latent image is developed and is transferred directly from said image holding material onto the recording medium.

* * * * *